US011644779B2

(12) United States Patent
Nakai

(10) Patent No.: US 11,644,779 B2
(45) Date of Patent: May 9, 2023

(54) IMAGE FORMING APPARATUS WITH TONER DENSITY ADJUSTMENT CONTROL

(71) Applicant: KYOCERA Document Solutions Inc., Osaka (JP)

(72) Inventor: Jun Nakai, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/467,154

(22) Filed: Sep. 3, 2021

(65) Prior Publication Data

US 2022/0082973 A1 Mar. 17, 2022

(30) Foreign Application Priority Data

Sep. 10, 2020 (JP) ..... JP2020-152070

(51) Int. Cl.
*G03G 15/00* (2006.01)

(52) U.S. Cl.
CPC ..... *G03G 15/5025* (2013.01)

(58) Field of Classification Search
CPC ..... G03G 15/5025
See application file for complete search history.

(56) References Cited

U.S. PATENT DOCUMENTS

2012/0075659 A1* 3/2012 Sawada ..... G03G 15/55 358/1.14

FOREIGN PATENT DOCUMENTS

JP 2002-333745 11/2002

* cited by examiner

*Primary Examiner* — Roy Y Yi
*Assistant Examiner* — Andrew V Do
(74) *Attorney, Agent, or Firm* — Lex IP Meister, PLLC

(57) ABSTRACT

An image forming apparatus includes an image carrier, a developing device, a control unit, and a density measuring unit. An electrostatic latent image is formed on the surface of an image carrier. A developing device supplies toner to the image carrier and develops the electrostatic latent image formed on the image carrier to form a toner image. The density measuring unit measures the toner density of the plurality of first patch toner images formed by the developing device. The control unit calculates a relationship between the toner density of the plurality of first patch toner images measured by the density measuring unit and the applied voltage applied to the developing device when the plurality of first patch toner images are formed, and adjusts the applied voltage based on a calculation result.

5 Claims, 10 Drawing Sheets

IMAGE FORMING APPARATUS WITH TONER DENSITY ADJUSTMENT CONTROL

INCORPORATION BY REFERENCE

This application is based upon and claims the benefit of priority from the corresponding Japanese Patent Application No. 2020-152070 filed on Sep. 10, 2020, the entire contents of which are incorporated herein by reference.

BACKGROUND

The present disclosure relates to an image forming apparatus.

An image forming apparatus such as a printer or a copier adopting an electrophotographic system forms an image on a recording medium such as paper based on image data. For the purpose of stabilizing the image quality of a formed image, there is a technique of detecting a developing current flowing into a developing roller when a print check pattern is formed on a photosensitive drum in a developing step, and controlling a charging potential and a developing bias based on the detection result.

However, when the charge amount of the toner used in the image forming apparatus varies depending on the environment or time, the toner adhesion amount of the toner image formed on the photosensitive drum varies, and the image density of the output image is not stable in some cases.

SUMMARY

An image forming apparatus according to this disclosure includes a an image carrier, a developing device, a control unit, and a density measuring unit.

An electrostatic latent image is formed on the surface of an image carrier.

A developing device supplies toner to the image carrier and develops the electrostatic latent image formed on the image carrier to form a toner image.

A control unit controls an applied voltage applied to the developing device when the toner image is developed by the developing device.

A density measuring unit measures the toner density of the toner image.

The developing device forms a plurality of first patch toner images for measuring toner density.

The control unit controls the applied voltage to a different applied voltage, respectively, when the developing device forms the plurality of first patch toner images.

The density measuring unit measures the toner density of the plurality of first patch toner images formed by the developing device.

The control unit calculates a relationship between the toner density of the plurality of first patch toner images measured by the density measuring unit and the applied voltage applied to the developing device when the plurality of first patch toner images are formed, and adjusts the applied voltage based on a calculation result.

DETAILED DESCRIPTION

Figure 1:
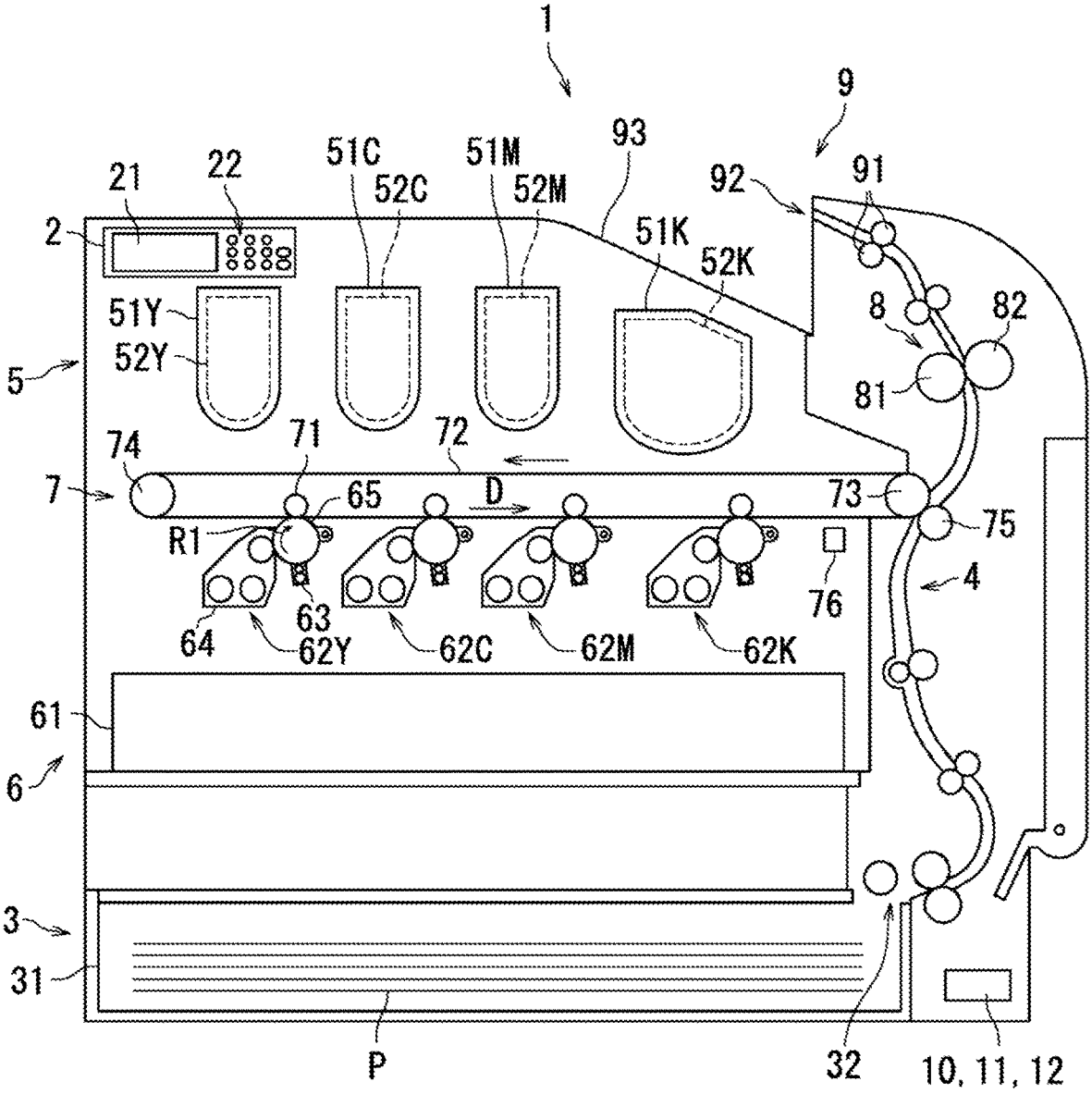
FIG. 1 is a diagram illustrating an example of a configuration of image forming apparatus 1.

Hereinafter, embodiments of the present disclosure will be described with reference to the drawings. In the drawings, the same or corresponding portions are denoted by the same reference numerals, and description thereof will not be repeated.

Referring to FIG. 1, the configuration of the image forming apparatus 1 according to the embodiment of the present disclosure will be described. FIG. 1 is a diagram showing an example of image forming apparatus 1. The image forming apparatus 1 is, for example, a tandem color printer.

As shown in FIG. 1, the image forming apparatus 1 includes an operation unit 2, a paper feed unit 3, a conveyance unit 4, a toner replenishing unit 5, an image forming unit 6, a transfer unit 7, a fixing unit 8, a discharge unit 9, and a control unit 10.

The operation unit 2 receives an instruction from a user. Upon receiving an instruction from the user, the operation unit 2 transmits a signal indicating the instruction from the user to the control unit 10. The operation unit 2 includes a liquid crystal display 21 and a plurality of operation keys 22. The liquid crystal display 21 displays, for example, various processing results. The operation keys 22 include, for example, a ten key and a start key. When the instruction indicating the execution of the image forming process is input, the operation unit 2 transmits a signal indicating the execution of the image forming process to the control unit 10. As a result, the image forming operation by image forming apparatus 1 is started.

The paper feed unit 3 includes a paper feed cassette 31 and a paper feed roller group 32. The paper feed cassette 31 can accommodate a plurality of sheets of paper P. The paper feed roller group 32 feeds the sheets of paper P stored in the paper feed cassette 31 one by one to the conveyance unit 4. The sheet of paper p is an example of a recording medium.

The conveyance unit 4 includes a roller and a guide member. The conveyance unit 4 extends from the paper feed unit 3 to the discharge unit 9. The conveyance unit 4 conveys the sheet of paper p from the paper feed unit 3 to the discharge unit 9 via the image forming unit 6 and the fixing unit 8.

The toner replenishing unit 5 replenishes toner to the image forming unit 6. The toner replenishing unit 5 includes a first mounting portion 51Y, a second mounting portion 51C, a third mounting portion 51M, and a fourth mounting portion 51K. The toner replenishing unit 5 is an example of a developer replenishing portion. The toner is an example of a developer.

The first toner container 52Y is mounted on the first mounting portion 51Y. Similarly, the second toner container 52C is mounted on the second mounting portion 51C, the third toner container 52M is mounted on the third mounting portion 51M, and the fourth toner container 52K is mounted on the fourth mounting portion 51K. The configurations of the first mounting portion 51Y to the fourth mounting portion 51K are the same except that the types of toner containers to be mounted are different. Therefore, the first mounting portion 51Y to the fourth mounting portion 51K may be collectively referred to as a "mounting portion 51".

Toner is stored in each of the first toner container 52Y, the second toner container 52C, the third toner container 52M, and the fourth toner container 52K. In the present embodiment, the first toner container 52Y contains yellow toner. The second toner container 52C contains cyan toner. The third toner container 52M contains magenta toner. The fourth toner container 52K contains the black toner.

The image forming unit 6 includes an exposure device 61, a first image forming unit 62Y, a second image forming unit 62C, a third image forming unit 62M, and a fourth image forming unit 62K.

Each of the first image forming unit 62Y to the fourth image forming unit 62K includes a charging device 63, a developing device 64, and a photosensitive drum 65. The photosensitive drum 65 is an example of an image carrier.

The charging device 63 and the developing device 64 are arranged along the circumferential surface of the photosensitive drum 65. In the present embodiment, the photosensitive drum 65 rotates in a direction (clockwise) indicated by an arrow R1 in FIG. 1.

The charging device 63 uniformly charges the photosensitive drum 65 to a predetermined polarity by discharging. In the present embodiment, the charging device 63 positively charges the photosensitive drum 65. The exposure device 61 irradiates the charged photosensitive drum 65 with laser light. As a result, an electrostatic latent image is formed on the surface of the photosensitive drum 65.

The developing device 64 develops the electrostatic latent image formed on the surface of the photosensitive drum 65 to form a toner image. The developing device 64 is replenished with toner from the toner replenishing unit 5. The developing device 64 supplies the toner replenished from the toner replenishing unit 5 to the surface of the photosensitive drum 65. As a result, a toner image is formed on the surface of the photosensitive drum 65.

In the present embodiment, the developing device 64 included in the first image forming unit 62Y is connected to the first mounting portion 51Y. Therefore, the developing device 64 of the first image forming unit 62Y is replenished with yellow toner. Thus, a yellow toner image is formed on the surface of the photosensitive drum 65 of the first image forming unit 62Y.

The developing device 64 included in the second image forming unit 62C is connected to the second mounting portion 51C. Therefore, the developing device 64 of the second image forming unit 62C is replenished with cyan toner. Thus, a cyan toner image is formed on the surface of the photosensitive drum 65 of the second image forming unit 62C.

The developing device 64 included in the third image forming unit 62M is connected to the third mounting portion 51M. Therefore, the developing device 64 of the third image forming unit 62M is replenished with magenta toner. Thus, a magenta toner image is formed on the surface of the photosensitive drum 65 of the third image forming unit 62M.

The developing device 64 included in the fourth image forming unit 62K is connected to the fourth mounting portion 51K. Therefore, the developing device 64 of the fourth image forming unit 62K is replenished with black toner. Thus, a black toner image is formed on the surface of the photosensitive drum 65 of the fourth image forming unit 62K.

The transfer unit 7 transfers the toner images formed on the surfaces of the photosensitive drums 65 of the first image forming unit 62Y to the fourth image forming unit 62K onto the sheet of paper p in an overlapping manner. In the present embodiment, the transfer unit 7 transfers the toner images onto the sheet of paper p in overlapping manner by a secondary transfer method. Specifically, the transfer unit 7 includes four primary transfer rollers 71, an intermediate transfer belt 72, a driving roller 73, a driven roller 74, a secondary transfer roller 75, and a density sensor 76.

The intermediate transfer belt 72 is an endless belt stretched around four primary transfer rollers 71, a driving roller 73, and a driven roller 74. The intermediate transfer belt 72 is driven in accordance with the rotation of the driving roller 73. In FIG. 1, the intermediate transfer belt 72 rotates counterclockwise. The driven roller 74 is rotationally driven in accordance with the driving of the intermediate transfer belt 72.

The first image forming unit 62Y to the fourth image forming unit 62K are disposed to face the lower surface of the intermediate transfer belt 72 along the driving direction D of the lower surface of the intermediate transfer belt 72. In the present embodiment, the first image forming unit 62Y to the fourth image forming unit 62K are arranged in the order of the first image forming unit 62Y to the fourth image forming unit 62K from the upstream side to the downstream side in the driving direction D of the lower surface of the intermediate transfer belt 72.

Each primary transfer roller 71 is disposed to face each photosensitive drum 65 via the intermediate transfer belt 72, and is pressed toward each photosensitive drum 65. Therefore, the toner images formed on the surfaces of the photosensitive drums 65 are sequentially transferred onto the intermediate transfer belt 72. In the present embodiment, a yellow toner image, a cyan toner image, a magenta toner image, and a black toner image are transferred onto the intermediate transfer belt 72 so as to overlap each other in this order. Hereinafter, the toner image in which the yellow toner image, the cyan toner image, the magenta toner image, and the black toner image are superimposed may be referred to as a "laminated toner image".

The secondary transfer roller 75 is disposed to face the driving roller 73 via the intermediate transfer belt 72. The secondary transfer roller 75 is pressed against the driving roller 73. As a result, a transfer nip is formed between the secondary transfer roller 75 and the driving roller 73. When the sheet of paper p passes through the transfer nip, the laminated toner image on the intermediate transfer belt 72 is transferred to the sheet of paper p. In the present embodiment, the yellow toner image, the cyan toner image, the magenta toner image, and the black toner image are transferred onto the sheet of paper p in this order from the upper layer to the lower layer. The sheet of paper p on which the laminated toner image is transferred is conveyed toward the fixing unit 8 by the conveyance unit 4.

The density sensor 76 is disposed to face the intermediate transfer belt 72 in a position more downstream than the first image forming unit 62Y to the fourth image forming unit 62K, and measures the density (toner density) of the laminated toner image formed on the photosensitive drum 65.

The density sensor 76 may measure the density of the laminated toner image on the intermediate transfer belt 72 or the density of the toner image fixed on the sheet of paper p.

The fixing unit 8 includes a heating member 81 and a pressing member 82. The heating member 81 and the pressing member 82 are disposed to face each other to form a fixing nip. The sheet of paper p conveyed from the image forming unit 6 passes through the fixing nip, and is pressurized while being heated at a predetermined fixing temperature. As a result, the laminated toner image is fixed to the sheet of paper p. The sheet of paper p is conveyed from the fixing unit 8 toward the discharge unit 9 by the conveyance unit 4.

The discharge unit 9 includes a discharge roller pair 91 and a discharge tray 93. The discharge roller pair 91 conveys the sheet of paper p to the discharge tray 93 via the discharge port 92. The discharge port 92 is formed on top of the image forming apparatus 1.

The control unit 10 controls the operation of each unit of the image forming apparatus 1. The control unit 10 includes a processor 11 and a storage unit 12. The processor 11 includes, for example, a CPU (Central Processing Unit). The storage unit 12 includes a memory such as a semiconductor memory, and may include a HDD (Hard Disk Drive). The storage unit 12 stores a control program. The processor 11 controls the operation of the image forming apparatus 1 by executing the control program.

Figure 2:
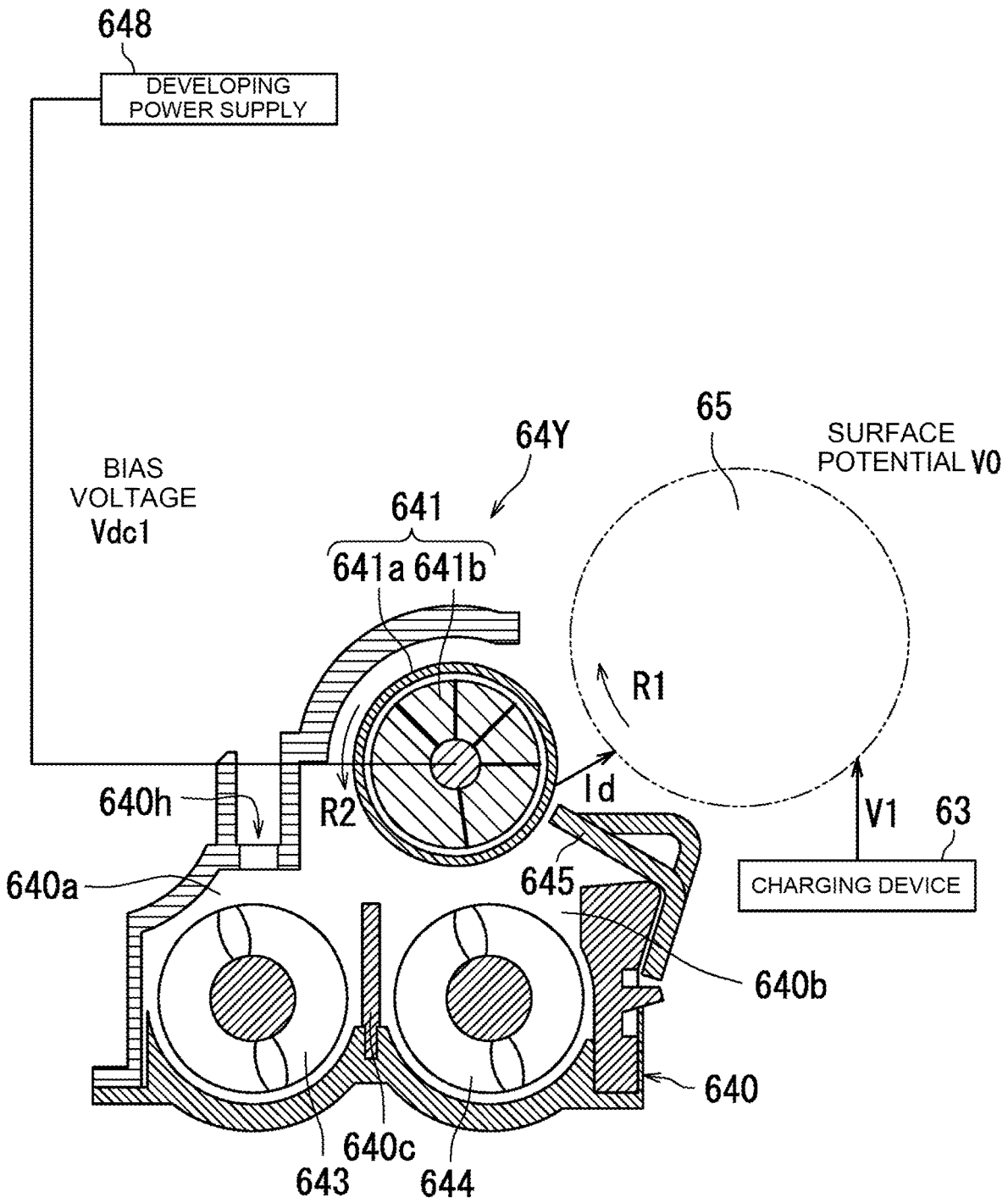
FIG. 2 is a diagram illustrating an example of a configuration of the developing device 64.

Next, the configuration of the developing device 64 will be described in detail with reference to FIG. 2. FIG. 2 shows an example of a configuration of the developing device 64. Specifically, FIG. 2 shows the first developing device 64Y of the first image forming unit 62Y. In FIG. 2, the photosensitive drum 65 is shown by a two-dot chain line for ease of understanding. In the present embodiment, the first developing device 64Y develops the electrostatic latent images formed on the surfaces of the photosensitive drums 65 by a two component developing method. As already described with reference to FIG. 1, the developing vessel 640 of the first developing device 64Y is connected to the first toner container 52Y. Therefore, the developing vessel 640 of the first developing device 64Y is replenished with the yellow toner through the toner replenishing port 640*h*.

As shown in FIG. 2, the first developing device 64Y includes a developing roller 641, a first stirring screw 643, a second stirring screw 644, and a blade 645 inside a developing vessel 640. Specifically, the developing roller 641 is disposed to face the second stirring screw 644. The blade 645 is disposed to face the developing roller 641.

The developing vessel 640 is partitioned into a first stirring chamber 640*a* and a second stirring chamber 640*b* by a partition wall 640*c*. The partition wall 640*c* extends in the axial direction of the developing roller 641. The first stirring chamber 640*a* and the second stirring chamber 640*b* communicate with each other outside both ends of the partition wall 640*c* in the longitudinal direction.

A first stirring screw 643 is disposed on the first stirring chamber 640*a*. The magnetic carriers are accommodated in the first stirring chamber 640*a*. Non-magnetic toner is supplied to the first stirring chamber 640*a* through the toner replenishing port 640*h*. In the example shown in FIG. 2, the yellow toner is supplied to the first stirring chamber 640*a*.

A second stirring screw 644 is disposed on the second stirring chamber 640*b*. A magnetic carrier is accommodated in the second stirring chamber 640*b*.

The yellow toner is stirred by the first stirring screw 643 and the second stirring screw 644 to be mixed with the carrier. As a result, a two component developer including the carrier and the yellow toner is formed. Since the two component developer is an example of the developer, the two component developer may occasionally be abbreviated as "developer" hereinafter.

The first stirring screw 643 and the second stirring screw 644 circulate and stir the developer between the first stirring chamber 640*a* and the second stirring chamber 640*b*. As a result, the toner is charged to a predetermined polarity. In the present embodiment, the toner is positively charged.

The developing roller 641 includes a non-magnetic rotating sleeve 641*a* and a magnet body 641*b*. The magnet body 641*b* is fixedly arranged inside the rotating sleeve 641*a*. The magnet body 641*b* includes a plurality of magnetic poles. The developer is attracted to the developing roller 641 by the magnetic force of the magnet body 641*b*. As a result, a magnetic brush is formed on the surface of the developing roller 641.

In the present embodiment, the developing roller 641 rotates in a direction indicated by an arrow R2 (counterclockwise) in FIG. 2. The developing roller 641 conveys the magnetic brush to a position facing the blade 645 by rotating. The blade 645 is disposed so that a gap is formed between the blade 645 and the developing roller 641. Thus, the thickness of the magnetic brush is defined by the blades 645. The blade 645 is disposed upstream of a position where the developing roller 641 and the photosensitive drum 65 face each other in the rotation direction of the magnetic roller 642.

A predetermined voltage (developing bias voltage) is applied to the developing roller 641 under the control of the control unit 10. As a result, the developer layer formed on the surface is conveyed to a position facing the photosensitive drum 65, and the toner in the developer adheres to the photosensitive drum 65.

For example, when an instruction indicating execution of the image forming process is input to image forming apparatus 1 by the user, the control unit 10 controls the image forming unit 6 to start the image forming operation of each unit included in the image forming apparatus 1. To be specific, the control unit 10 controls the charging device 63, the first developing device 64Y, the developing power supply 648, and the exposure device 61.

The charging device 63 charges the surfaces of the photosensitive drums 65 to a predetermined charging potential (surface potential V0) under the control of the control unit 10. Specifically, when the charging device 63 applies a charging bias to the photosensitive drum 65, the surfaces of the photosensitive drum 65 are charged to a surface potential V0.

The developing power supply 648 applies a developing bias voltage to the developing roller 641 under the control of the control unit 10. The developing bias voltage includes a DC component and an AC component. FIG. 2 shows a case where a developing bias voltage, in which the magnitude (Vdc1) of DC components is larger than the surface potential V0, is applied to the developing roller 641. The bias voltage does not have to include an AC component.

Under the control of the control unit 10, the exposure device 61 emits laser light to the photosensitive drum 65 whose surface potential V0 has been charged by the charging device 63. As a result, an electrostatic latent image is formed on the surface of the photosensitive drum 65. The charging potential V1 of the portion where the electrostatic latent images are formed on the surfaces of the photosensitive drums 65 becomes smaller than the surface potential V0.

When the electrostatic latent images are formed on the surfaces of the photosensitive drums 65, the first developing devices 64Y develop the electrostatic latent images formed on the surfaces of the photosensitive drums 65 under the control of the control unit 10.

At this time, the toner developed on the photosensitive drum 65 is measured as a developing current Id. That is, the developing current Id indicates the amount of toner moved from the developing roller 641 to the photosensitive drum 65 according to the difference (contrast voltage) between the surface potential V0 and the charging potential V1.

The configuration of the developing device 64 included in each of the first image forming unit 62Y to the fourth image forming unit 62K is substantially the same except that the type of toner replenished from the toner replenishing unit 5 is different. Therefore, description of the configuration of the second developing device 64C to the fourth developing device 64K included in the second image forming unit 62C to the fourth image forming unit 62K will be omitted.

Here, in a case where the contrast voltage by the discharge and the exposure is constant and the charge amount of the toner is always constant, the amount of the toner moving from the developing roller 641 to the photosensitive drum 65 is constant, and thus the toner density measured by the density sensor 76 is constant.

However, for example, when the photosensitive drums 65 made of different materials from each other are irradiated with laser light having the same exposure energy, the contrast voltages are different from each other. Specifically, in the photosensitive drum 65 made of a-Si (amorphous silicon), the voltage of the contrast voltage is likely to change greatly as compared with the photosensitive drum 65 made of an organic photosensitive member (OPC).

Further, since the charge amount of the toner is not always constant due to environmental conditions or the like, even when the contrast voltage is the same, the amount of the toner moving from the developing roller 641 to the photosensitive drum 65 is not always constant.

In order to measure a constant toner density by the density sensor 76, for example, the present embodiment has a developing bias voltage adjustment mode for adjusting the developing bias voltage applied to the developing roller 641. The developing bias voltage adjustment mode is started, for example, when an instruction indicating execution of the developing bias voltage adjustment mode is input by the user between image forming processes.

[Adjustment of Developing Bias Voltage]

When the developing bias voltage adjustment mode is started, the image forming unit 6 forms a plurality of first patch images on the sheet of paper p. Specifically, the developing device 64 forms a plurality of first patch toner images. The first patch toner image is, for example, a quadrangle having four 10 mm sides. With such a size, the toner consumption can be suppressed.

Figure 3:
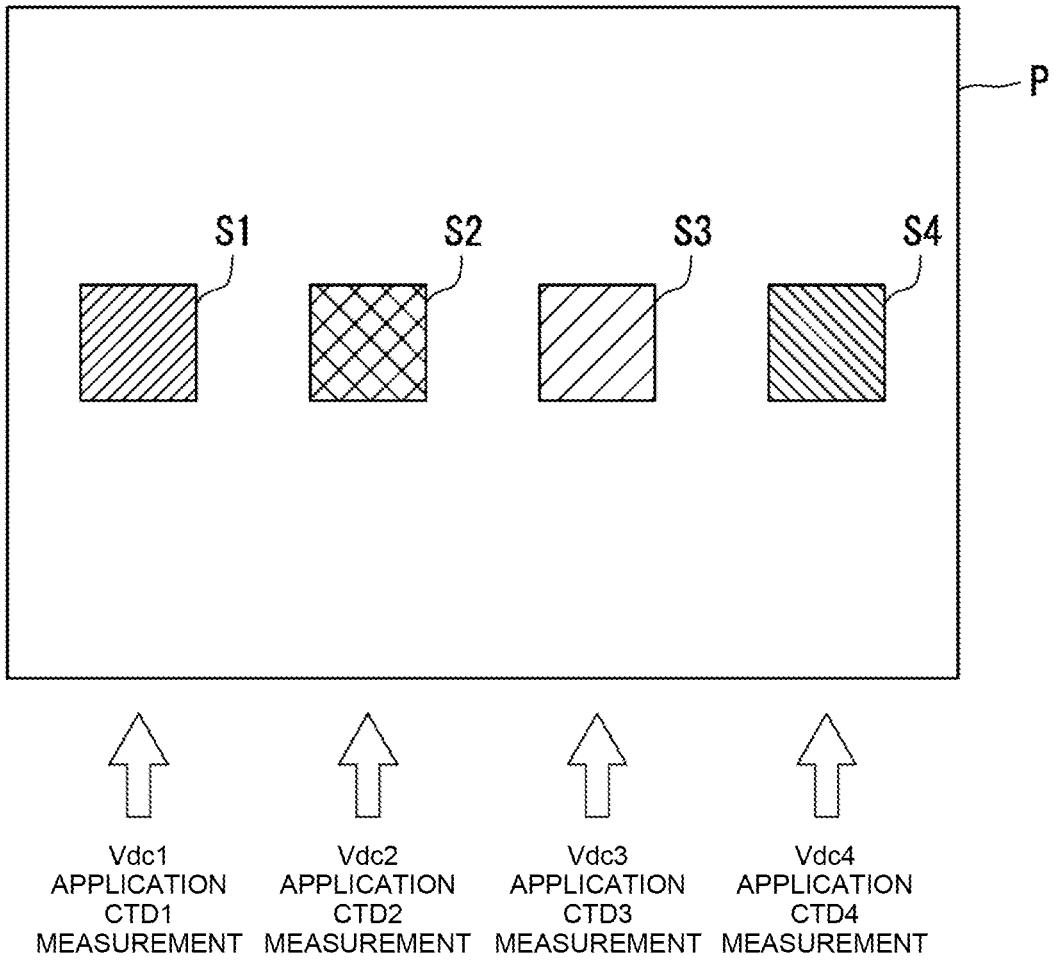
FIG. 3 is a diagram showing a plurality of first patch images formed on the sheet of paper p.

Next, the first patch image and the first patch toner image will be described with reference to FIG. 3. FIG. 3 is a diagram showing a plurality of first patch images formed on the sheet of paper p.

The developing device 64 forms the first patch toner images S1 to S4. When the first patch toner images S1 to S4 are formed, respectively different developing bias voltages are applied to the developing roller 641. For example, under the control of the control unit 10, the developing bias voltage Vdc1 is applied when the first patch toner image S1 is formed; the developing bias voltage Vdc2 is applied when the first patch toner image S2 is formed; the developing bias voltage Vdc3 is applied when the first patch toner image S3 is formed; and the developing bias voltage Vdc4 is applied when the first patch toner image S4 is formed.

The density sensor 76 measures the toner density of the first patch toner images S1 to S4 formed by the developing device 64. The control unit 10 acquires the measurement result of the density sensor 76. For example, the control unit 10 acquires the toner density CTD1 to CTD4 of each of the first patch toner images S1 to S4 measured by the density sensor 76.

The control unit 10 calculates the correlation between the toner density and the developing bias voltage based on the acquired toner density CTD1 to CTD4 and the acquired developing bias voltage "Vdc1 to Vdc4".

Figure 4:
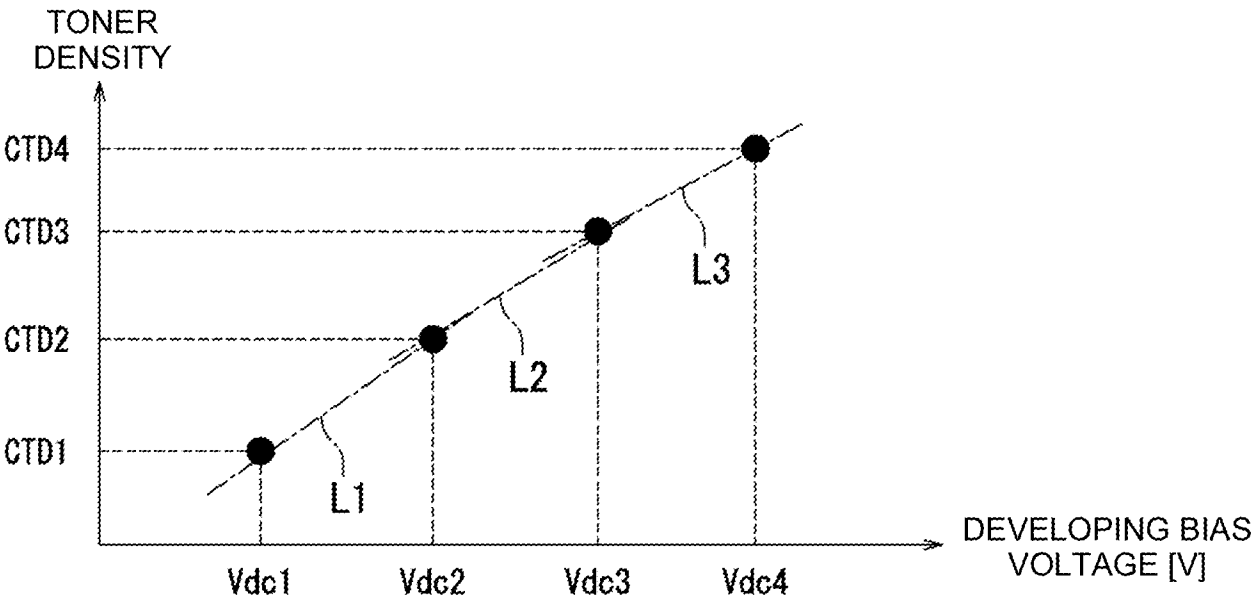
FIG. 4 is a graph showing the correlation between the toner density and the developing bias voltage in the present embodiment.

Next, the toner density and the developing bias voltage in the present embodiment will be described with reference to FIG. 4. FIG. 4 is a graph showing the correlation between the toner density and the developing bias voltage in the present embodiment. In FIG. 4, the vertical axis represents the toner density and the horizontal axis represents the developing bias voltage.

In the present embodiment, it is assumed that the toner density is highest at CTD4 and decreases in the order of CTD3, CTD2, CTD1. It is assumed that the developing bias voltage is highest at Vdc4 and decreases in the order of Vdc3, Vdc2, Vdc1. In general, as the developing bias voltage increases, an image having a higher toner density is formed.

For example, the control unit 10 selects two first patch toner images from the first patch toner images S1 to S4, and calculates the relationship between the toner densities of the two first patch toner images and the developing bias voltages when the two first patch toner images are formed, as a linear function. In detail, the control unit 10 selects the first patch toner images S1 and S2, and calculates the linear function of the correlation L1 between the toner density and the developing bias voltage in the first patch toner images S1 and S2 based on the toner density CTD1 and the developing bias voltage Vdc1, and the toner density CTD2 and the developing bias voltage Vdc2.

Similarly, the control unit 10 calculates a linear function of the correlation L2 between the toner density and the developing bias voltage in the first patch toner images S2, and S3 based on the toner density CTD2 and the developing bias voltage Vdc2, and the toner density CTD3 and the developing bias voltage Vdc3, and calculates a linear function of the correlation L3 between the toner density and the developing bias voltage in the first patch toner images S3, and S4 based on the toner density CTD3 and the developing bias voltage Vdc3, and the toner density CTD4 and the developing bias voltage Vdc4.

As described above, when the correlation between the toner density and the developing bias voltage is known, it is possible to obtain the developing bias voltage for forming an image having a desired toner density.

Figure 5:
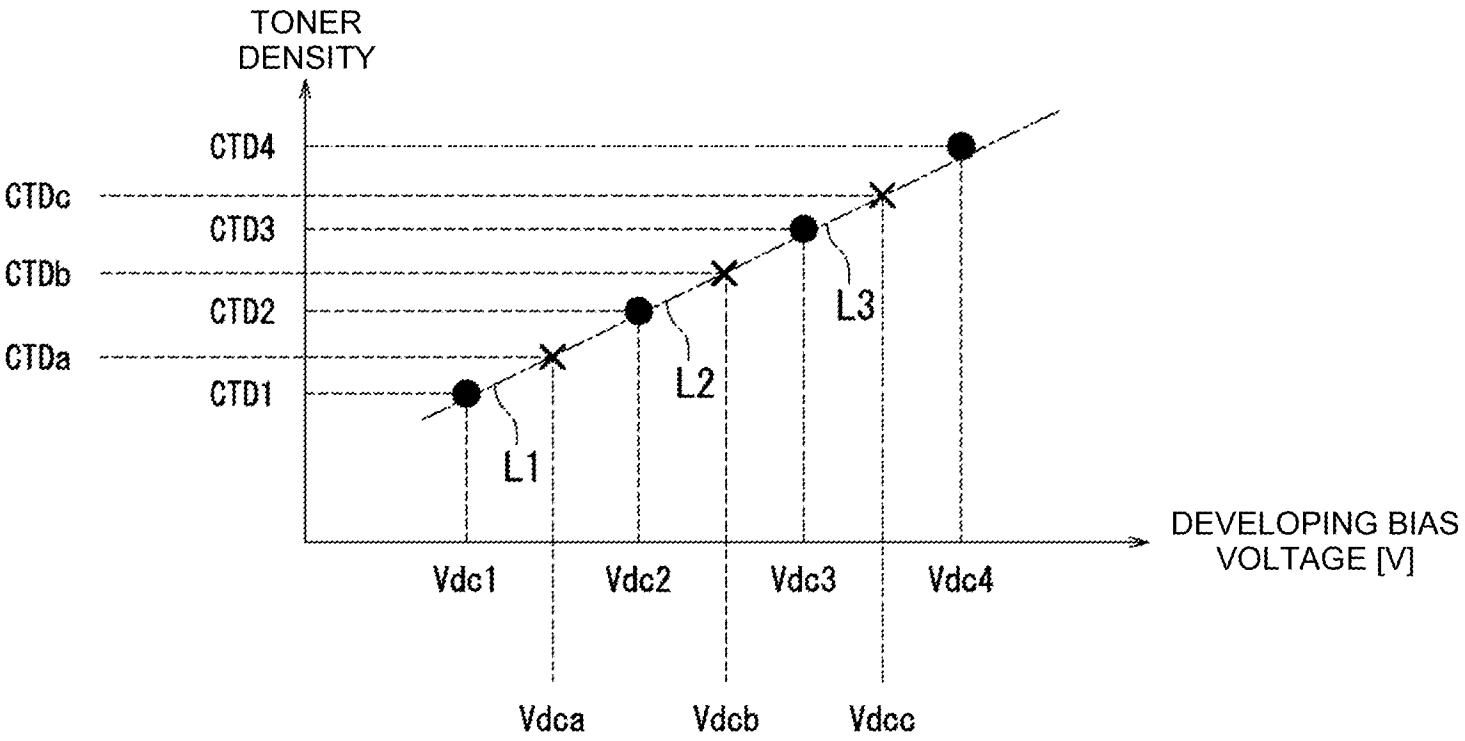
FIG. 5 is a graph obtained by adding a point at which a desired toner density is obtained to the graph of FIG. 4.

Next, a method of calculating a developing bias voltage for forming an image having a desired toner density in the present embodiment will be described with reference to FIGS. 5 to 8. FIG. 5 is a graph obtained by adding, to the graph of FIG. 4, a point at which a desired toner density is obtained. FIG. 5 shows a case where the desired toner density is a density is any of the toner densities CTD1 to CTD4.

For example, when the desired toner density is a toner density CTDa between the toner density CTD1 and the toner density CTD2 (CTD1<CTDa<CTD2), the developing bias voltage Vdca for forming an image having the toner density CTDa is calculated by the Equation (1).

$$Vdca = Vdc1 + (CTDa - CTD1)\frac{(Vdc2 - Vdc1)}{(CTD2 - CTD1)} \quad \text{[Equation 1]}$$

Similarly, when the desired toner density is a toner density CTDb between the toner density CTD2 and the toner density CTD3 (CTD2<CTDb<CTD3), and when the desired toner density is a toner density CTDc between the toner density CTD3 and the toner density CTD4 (CTD3<CTDc<CTD4), the corresponding developing bias voltage Vdcb and developing bias voltage Vdcc are calculated by modifying the Equation (1).

As described above, when the desired toner density is a toner density between the maximum density and the minimum density among the toner densities of the plurality of first patch toner images, an appropriate developing bias voltage can be obtained by the interpolation method.

Figure 6A:
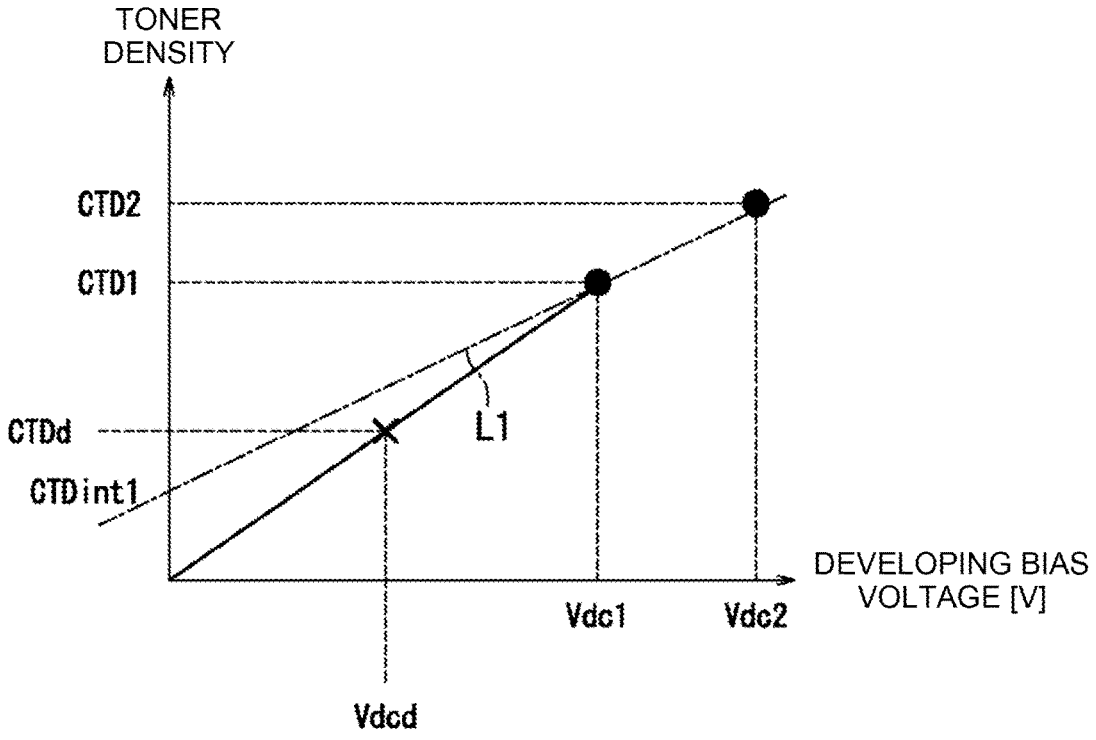
FIGS. 6A and 6B are views focusing on the correlation L1 in the graph of FIG. 4.
Figure 6B:
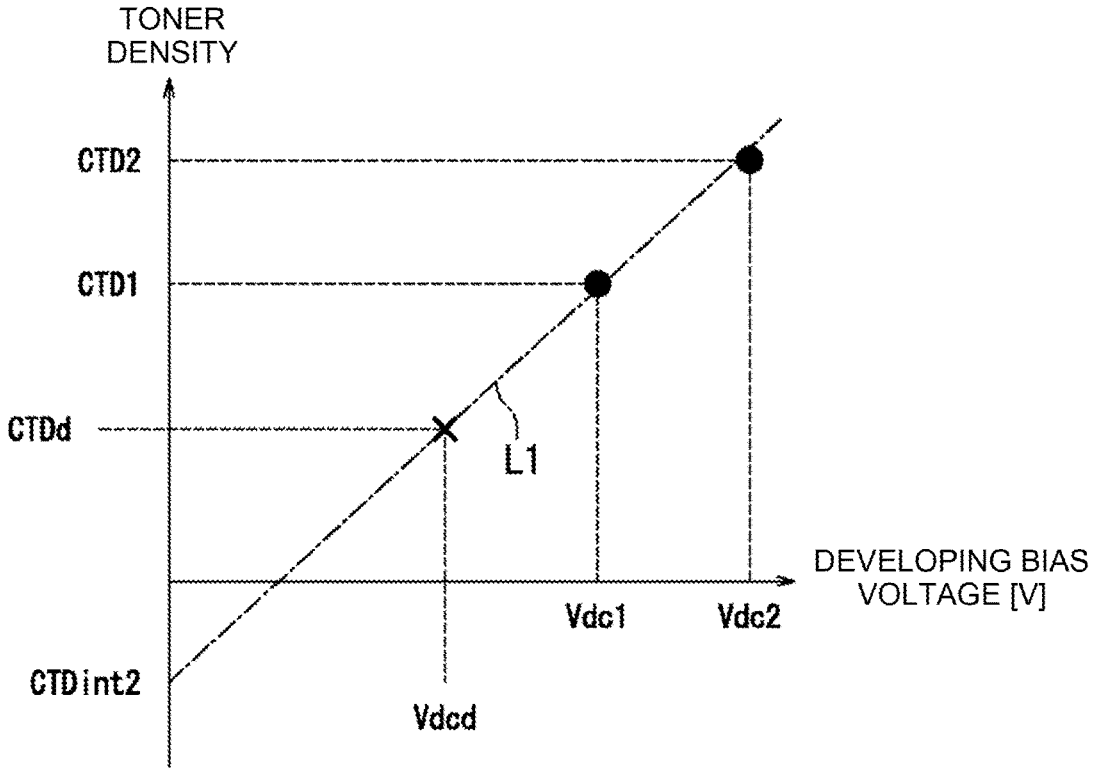

Next, as shown in FIGS. 6A and 6B, a method of calculating the developing bias voltage when the desired toner density is lower than the minimum density among the toner densities of the plurality of first patch toner images will be described. In this case, the control unit 10 selects two first patch toner images (first patch toner images S1, and S2) including the first patch toner image S1 having the minimum density. In this case, the calculation methods differ depending on the sign of the intercept CTDint of the correlation L1. FIGS. 6A and 6B show correlation L1 in the graph of FIG. 4. FIG. 6A shows a case where the intercept CTDint of the correlation L1 is 0 or more (CTDint1), and FIG. 6B shows a case where the intercept CTDint of the correlation L1 is less than 0 (CTDint2). The intercept CTDint is calculated by Equation (2).

$$CTDint = \frac{CTD1 \times Vdc2 - CTD2 \times Vdc1}{Vdc2 - Vdc1} \quad \text{[Equation 2]}$$

In the case (CTDint>0) shown in FIG. 6A, when the desired toner density is the toner density CTDd lower than the toner density CTD1 (CTDd<CTD1), the developing bias voltage Vdcd for forming the image of the toner density CTDd is calculated by the Equation (3).

By such calculation, it is possible to prevent the developing bias voltage Vdcd from becoming a negative value when the intercept CTDint is 0 or more (CTDint1).

$$Vdcd = \frac{CTDd \times Vdc1}{CTD1} \quad \text{[Equation 3]}$$

On the other hand, in the case shown in FIG. 6B (CTDint<0), when the desired toner density is the toner density CTDd lower than the toner density CTD1 (CTDd<CTD1), the developing bias voltage Vdcd for forming the image of the toner density CTDd is calculated by the Equation (4) by the extrapolating method.

$$Vdcd = Vdc1 + (CTDd - CTD1)\frac{Vdc2 - Vdc1}{(CTD2 - CTD1)} \quad \text{[Equation 4]}$$

Figure 7A:
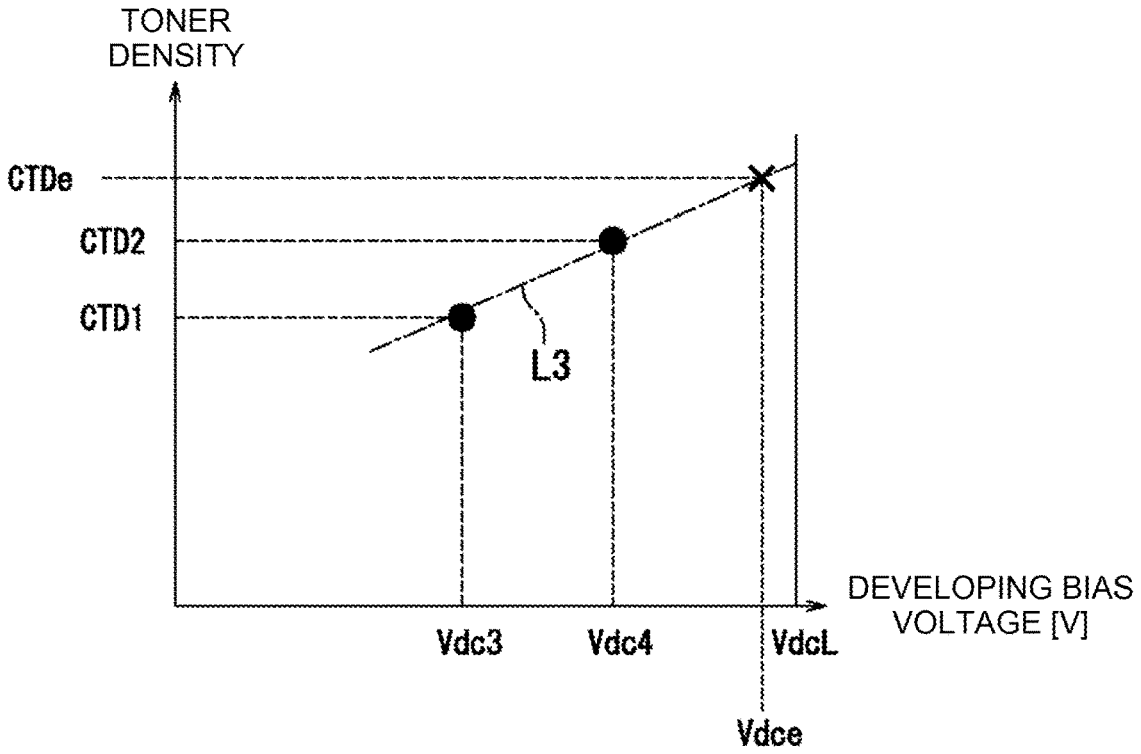
FIGS. 7A and 7B are views focusing on the correlation L3 in the graph of FIG. 4.
Figure 7B:
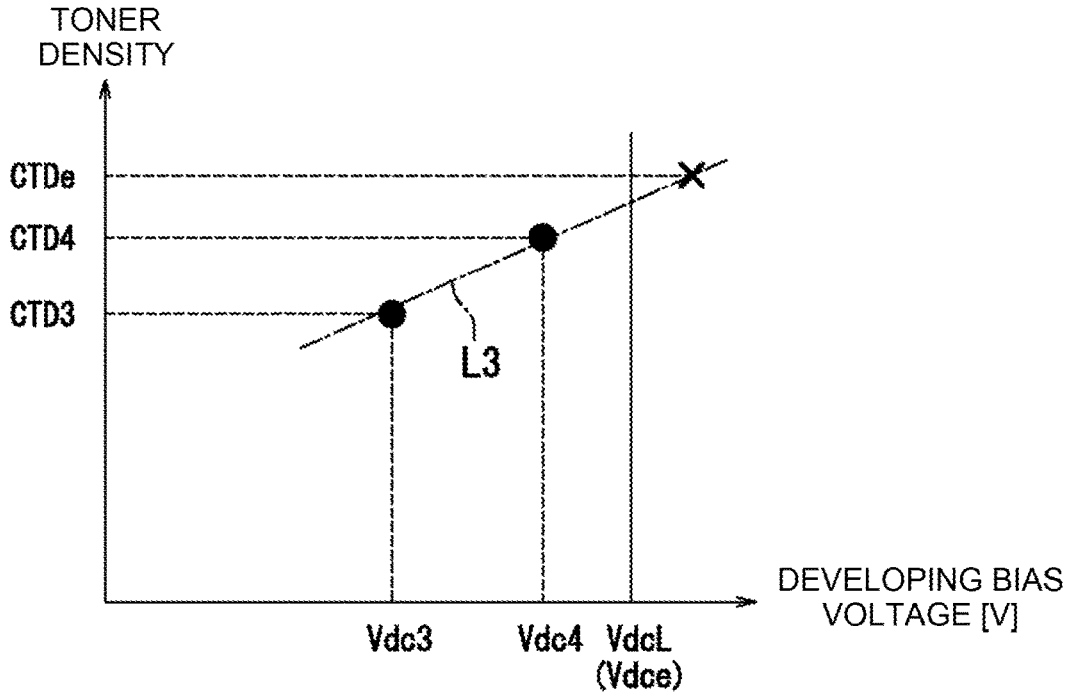

Next, as shown in FIGS. 7A and 7B, a method of calculating the developing bias voltage when the desired toner density is higher than the maximum toner density among the toner densities of the plurality of first patch toner images will be described. FIGS. 7A and 7B show a correlation L3 in the graph of FIG. 4.

As shown in FIG. 7A, when the desired toner density is CTDe which is higher than the toner density CTD4 (CTD4<CTDe), the control unit 10 selects two first patch toner images (first patch toner images S3 and S4) including the first patch toner image S4 having the maximum density. In this case, the developing bias voltage Vdce for forming the image having the toner density CTDe is calculated by the Equation (5) by the extrapolating method.

$$Vcde = Vdc3 + (CTDe - CDT3)\frac{Vdc4 - Vdc3}{(CTD4 - CTD3)} \quad \text{[Equation 5]}$$

When the calculated developing bias voltage Vdce becomes larger than the maximum output value VdcL of the developing bias voltage as shown in FIG. 7B, the maximum output value VdcL is set as the developing bias voltage Vdce.

Figure 8:
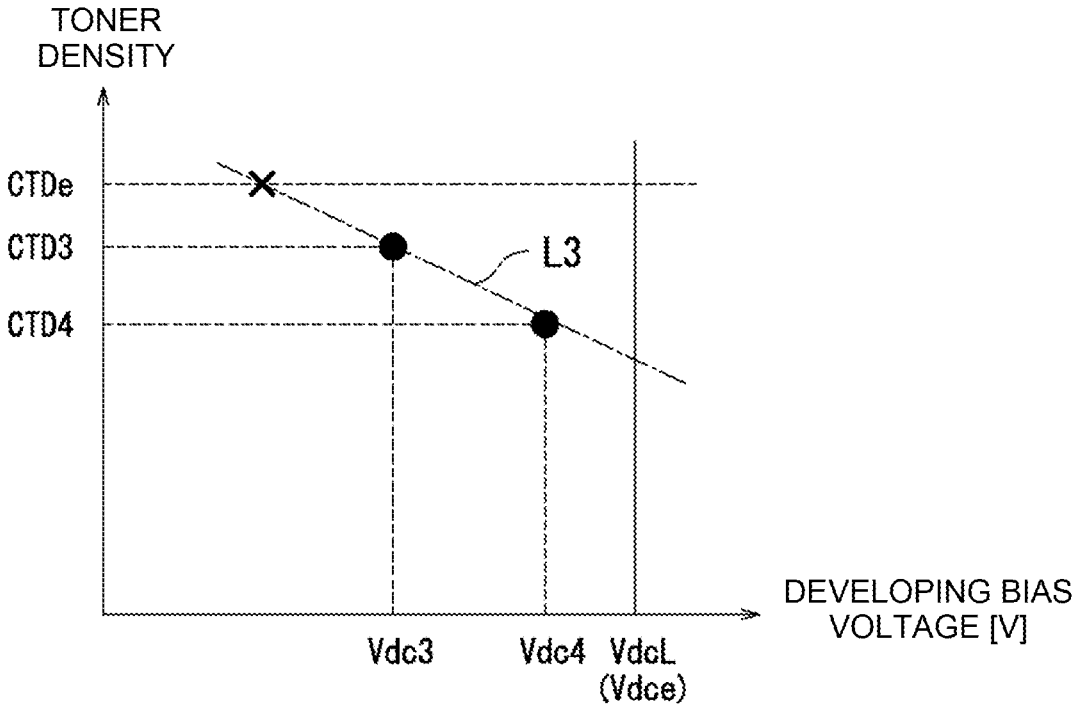
FIG. 8 is a diagram showing the correlation L3 when the toner density CTD4 is lower than the toner density CTD3.

Next, as shown in FIG. 8, a description will be given of how to calculate the developing bias voltage Vdce for forming an image having a toner density of CTDe which is higher than the toner density CTD3 when the toner density CTD 4 is lower than the toner density CTD3 (CTD4<CTD3<CTDe), for example. FIG. 8 is a diagram showing the correlation L3 when the toner density CTD 4 is lower than the toner density CTD3. In this case, since the slope of the linear function of the correlation L3 becomes negative, the developing bias voltage Vdce cannot be correctly calculated by the Equation (5) of the extrapolating method.

Therefore, when the slope of the linear function of the correlation L3 is negative, the developing bias voltage Vdce is set to the maximum output value VdcL of the developing bias voltage or the developing bias voltage Vdc4.

In the present embodiment, when the developing bias voltage for forming an image having a desired toner density is calculated, the developing bias voltage adjustment mode is ended.

[Prediction of Toner Charge Amount]

In the present embodiment, when the developing bias voltage for forming an image having a desired toner density is known, the toner charge amount of the toner in the developing vessel 640 can be more accurately known. For example, the present embodiment has a toner charge amount prediction mode for predicting the toner charge amount.

Figure 9:
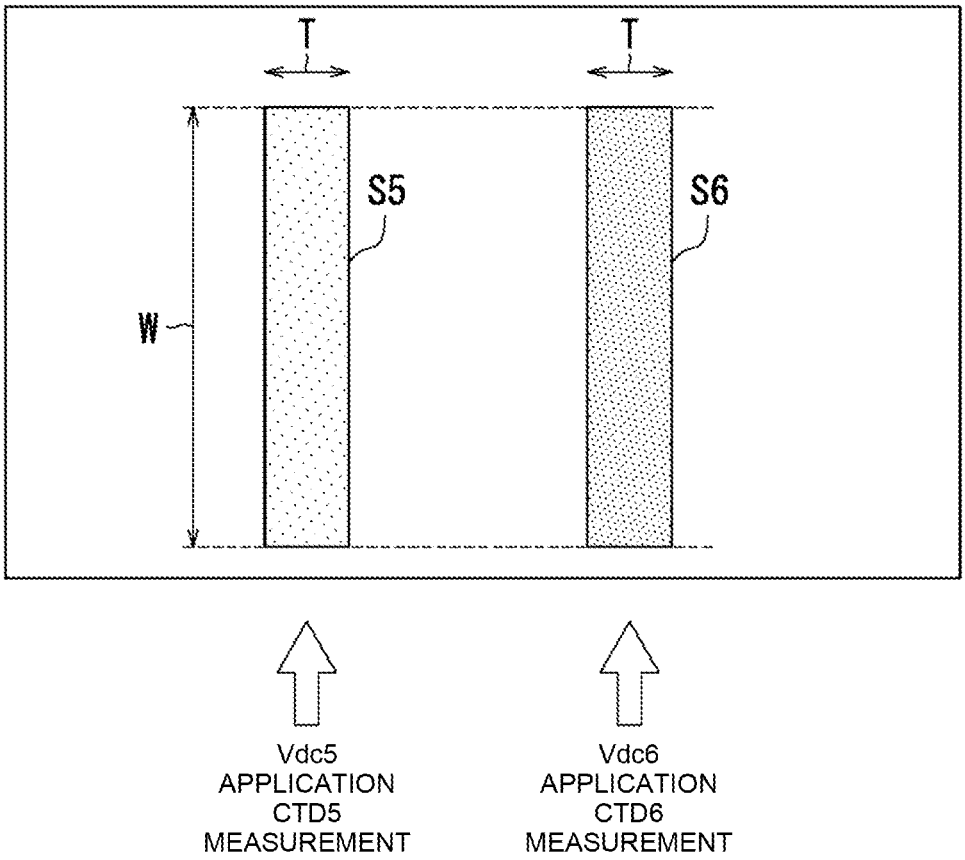
FIG. 9 is a diagram showing the second patch toner image for predicting the toner charge amount in the present embodiment.

Next, with reference to FIG. 9, the prediction of the toner charge amount in the present embodiment will be described. FIG. 9 is a diagram showing a second patch toner image for predicting the toner charge amount in the present embodiment.

In the present embodiment, when the toner charge amount prediction mode is started, the developing device 64 forms the second patch toner images S5, and S6. For example, the second patch toner images S5, and S6 have a W×T rectangular shape. W represents a length of the second patch toner images S5, and S6 in the direction orthogonal to the conveyance direction of the sheet of paper p. T represents a length of the second patch toner images S5, and S6 in the conveyance direction of the sheet of paper p. W is, for example, the maximum length in which an image can be formed in the width direction (axial direction) of the photosensitive drum 65. T is, for example, the minimum length in which the density sensor 76 can measure the toner density.

When the second patch toner images S5 and S6 are formed, a developing bias voltage adjusted so that the second patch toner images S5 and S6 have a desired toner density calculated in the developing bias voltage adjustment mode is applied to the developing roller 641 under the control of the control unit 10.

To be specific, under the control of the control unit 10, the developing bias voltage Vdc5 is applied when the second patch toner image S5 is formed, and the developing bias voltage Vdc6 is applied when the second patch toner image S6 is formed. At this time, the control unit 10 acquires the developing currents Id5 and Id6 measured when the second patch toner images S5 and S6 are developed.

The density sensor 76 measures the toner density of the second patch toner images S5 and S6 formed by the developing device 64. The control unit 10 acquires the measurement result of the density sensor 76. For example, the control unit 10 acquires the toner densities CTD5 and CTD6 of the second patch toner images S5 and S6 measured by the density sensor 76.

The control unit 10 calculates the toner charge amount of the toner in the developing vessel 640 based on the acquired difference between the developing currents Id5 and Id6, the difference between the toner densities CTD5 and CTD6, and the length W of the second patch toner images S5 and S6 in the direction orthogonal to the conveyance direction of the sheet of paper p.

Figure 10:
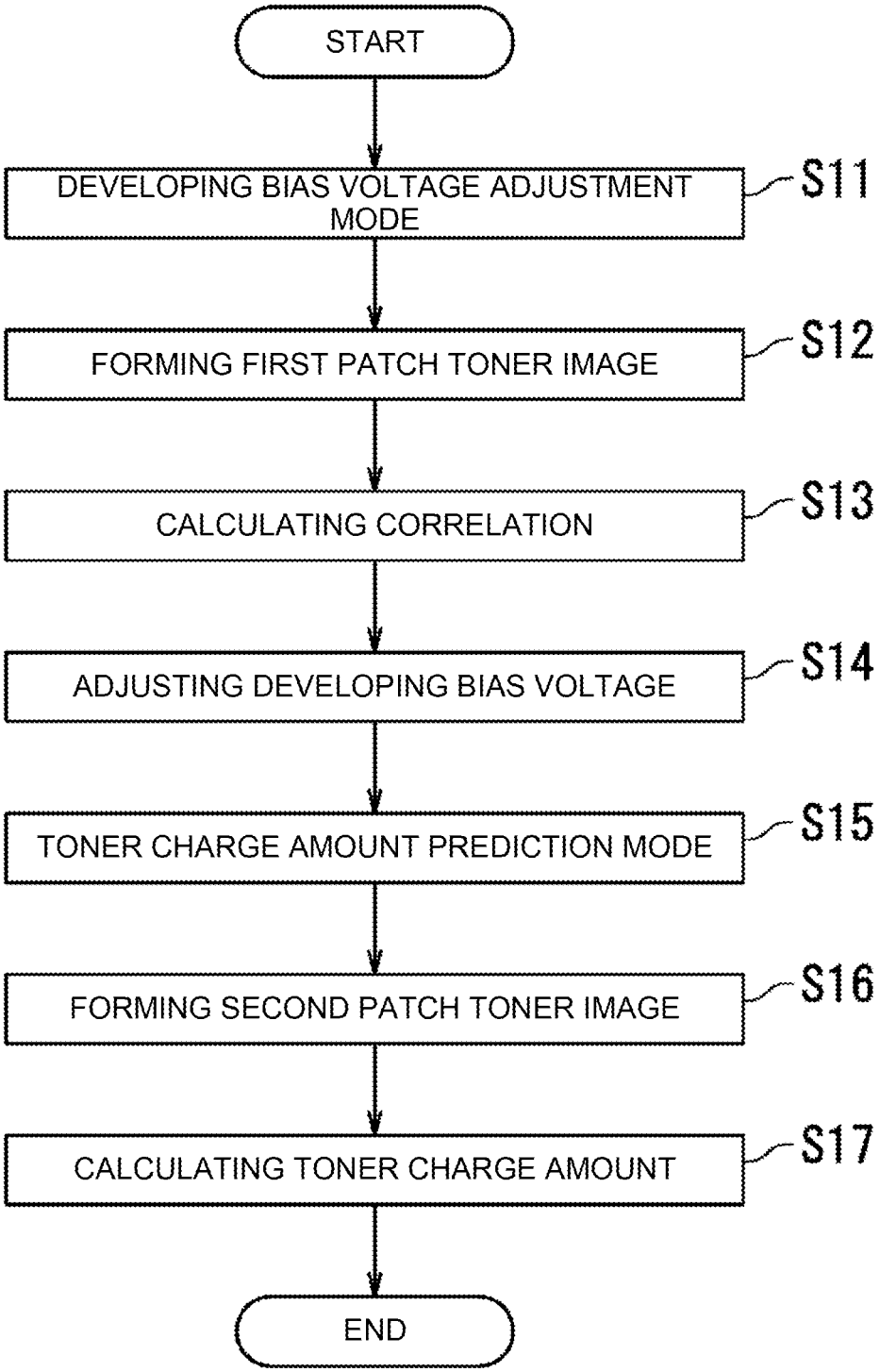
FIG. 10 is a flowchart showing the toner charge amount prediction process in the present embodiment.

Next, a toner charge amount prediction process according to the present embodiment will be described with reference to FIG. 10. FIG. 10 is a flowchart showing a toner charge amount prediction process in the present embodiment.

In the present embodiment, when the developing bias voltage adjustment mode is started (step S11), the developing device 64 forms a plurality of first patch toner images (step S12).

The control unit 10 calculates the correlation between the toner density and the developing bias voltage based on the toner density of the plurality of first patch toner images and the plurality of developing bias voltages when forming the plurality of first patch toner images (step S13).

The control unit 10 adjusts the developing bias voltage based on the correlation between the toner density and the developing bias voltage so that the second patch toner image having the desired toner density is formed in the toner charge amount prediction mode (step S14).

In the toner charge amount prediction mode (step S15), the developing device 64 forms the second patch toner image (step S16)

The control unit 10 calculates the toner charge amount of the toner in the developing vessel 640 based on the developing current when the second patch toner image is formed, the toner density of the second patch toner image, and the length W of the second patch toner image in the direction orthogonal to the conveyance direction of the sheet of paper p (step S17).

In the present exemplary embodiment, the density sensor 76 is disposed so as to face the intermediate transfer belt 72 and measures the density of the laminated toner image on the intermediate transfer belt 72. However, without being limited thereto, the density sensor 76 may be disposed so as to face the photosensitive drum 65 and measure the density of the toner image on the photosensitive drum 65.

According to the present disclosure, it is possible to form an image having a stable image density.

The embodiments of the present disclosure have been described above with reference to the drawings (FIGS. 1 to 10). However, the present disclosure is not limited to the above-described embodiment, and can be implemented in various aspects without departing from the scope of the disclosure. In the drawings, each component is schematically illustrated for ease of understanding, and the thickness, length, number, and the like of each illustrated component are different from actual ones for convenience of drawing preparation. In addition, the materials, shapes, dimensions, and the like of the respective constituent elements described in the above-described embodiment are merely examples, and are not particularly limited. Various modifications can be made without substantially departing from the effects of the present disclosure.

What is claimed is:

1. An image forming apparatus comprising:

an image carrier of which an electrostatic latent image is formed on a surface thereof;

a developing device that supplies toner to the image carrier and develops the electrostatic latent image formed on the image carrier to form a toner image;

a control unit that controls an applied voltage applied to the developing device when the toner image is developed by the developing device; and a density measuring unit that measures a toner density of the toner image, wherein the developing device forms a plurality of first patch toner images for measuring toner density, the control unit controls the applied voltage when the developing device forms each of the plurality of first patch toner images, to a respectively different applied voltage, the density measuring unit measures the toner density of the plurality of first patch toner images formed by the developing device, the control unit calculates a relationship between the toner density of the plurality of first patch toner images measured by the density measuring unit and the applied voltage applied to the developing device when the plurality of first patch toner images are formed, and adjusts the applied voltage based on a result of the calculation, the control unit calculates a calculation voltage for forming the toner image having a desired toner density based on the calculated relationship between the applied voltage and the toner density, and adjusts the applied voltage to the calculation voltage, the control unit selects two first patch toner images from the plurality of first patch toner images, and calculates a relationship between the toner densities of the two first patch toner images and the applied voltage applied to the developing device when the two first patch toner images are formed, as a linear function, when the desired toner density is between a maximum density and a minimum density among the toner densities of the plurality of first patch toner images, the control unit selects a first patch toner image having a toner density higher than the desired toner density and a first patch toner image having a toner density lower than the desired toner density among the plurality of first patch toner images, and calculates the calculation voltage by an interpolating method using the toner densities of the selected two first patch toner images and the applied voltages applied to the developing device when the two first patch toner images are formed, when the desired toner density is higher than the maximum density among the toner densities of the plurality of first patch toner images, the control unit selects two first patch toner images including the first patch toner image having the maximum density among the plurality of first patch toner images, and calculates the calculation voltage by an extrapolating method using the toner densities of the selected two first patch toner images and the applied voltage applied to the developing device when the two first patch toner images are formed, and wherein when the desired toner density is higher than the maximum toner density among the toner densities of the plurality of first patch toner images, the control unit selects two first patch toner images including a first patch toner image having the maximum density among the plurality of first patch toner images, and sets a maximum voltage that can be applied to the developing device as the calculation voltage, in the case where a slope of a linear function indicating a relationship between the toner densities of the selected two first patch toner images and the applied voltage applied to the developing device when the two first patch toner images are formed is a negative value.

2. The image forming apparatus according to claim 1, wherein when the desired toner density is lower than a minimum density among the toner densities of the plurality of first patch toner images, the control unit selects two first patch toner images including the first patch toner image having the minimum density among the plurality of first patch toner images, and calculates the calculation voltage by an extrapolating method using the toner densities of the selected two first patch toner images and the applied voltage applied to the developing device when the two first patch toner images are formed.

3. The image forming apparatus according to claim 1, wherein when the desired toner density is lower than a minimum density among the toner densities of the plurality of first patch toner images, the control unit selects two first patch toner images including the first patch toner image having the minimum density among the plurality of first patch toner images, and calculates the calculation voltage based on the toner density of the first patch toner image having the minimum density and the applied voltage applied to the developing device when the first patch toner image having the minimum density is formed, in the case where an intercept of a linear function indicating a relationship between the toner densities of the selected two first patch toner images and the applied voltage applied to the developing device when the two first patch toner images are formed is a positive value.

4. The image forming apparatus according to claim 1, wherein when a value of the calculation voltage is larger than a maximum voltage that can be applied to the developing device, the control unit sets the maximum voltage as the calculation voltage.

5. The image forming apparatus according to claim 1, wherein the developing device forms a second patch toner image for calculating a charge amount of the toner, and the control unit applies, to the developing device, the applied voltage after adjusting when the second patch toner image is formed by the developing device.

* * * * *